US008539783B1

(12) United States Patent
Bunch

(10) Patent No.: US 8,539,783 B1
(45) Date of Patent: Sep. 24, 2013

(54) SYSTEM FOR PREVENTING CONDENSATION ON REFRIGERATOR DOORS AND FRAMES

(75) Inventor: John Bunch, Phoenix, AZ (US)

(73) Assignee: Supermarket Energy Technologies, LLC, Phoenix, AZ (US)

( * ) Notice: Subject to any disclaimer, the term of this patent is extended or adjusted under 35 U.S.C. 154(b) by 809 days.

(21) Appl. No.: 12/710,285

(22) Filed: Feb. 22, 2010

Related U.S. Application Data

(63) Continuation-in-part of application No. 11/228,602, filed on Sep. 16, 2005, now abandoned, which is a continuation-in-part of application No. 10/778,289, filed on Feb. 11, 2004, now Pat. No. 7,240,501.

(51) Int. Cl.
*F25D 21/06* (2006.01)
*F25D 21/00* (2006.01)
*A47F 3/04* (2006.01)

(52) U.S. Cl.
USPC ..... 62/154; 62/150; 62/248

(58) Field of Classification Search
USPC ..... 62/150, 154, 156, 140, 248, 275; 165/222, 223, 230
See application file for complete search history.

(56) References Cited

U.S. PATENT DOCUMENTS

| | | | | |
|---|---|---|---|---|
| 3,859,502 | A | 1/1975 | Heaney | |
| 4,127,756 | A | 11/1978 | Peterson et al. | |
| 4,953,533 | A * | 9/1990 | Witt | 126/25 B |
| 5,778,689 | A | 7/1998 | Beatenbough | |
| 5,899,078 | A * | 5/1999 | Mager | 62/80 |
| 6,144,017 | A * | 11/2000 | Millett et al. | 219/522 |
| 6,347,746 | B1 | 2/2002 | Dage et al. | |
| 6,722,142 | B1 * | 4/2004 | Pagel | 62/131 |
| 7,207,181 | B2 | 4/2007 | Murray et al. | |
| 7,240,501 | B2 * | 7/2007 | Bunch et al. | 62/150 |
| 7,340,907 | B2 * | 3/2008 | Vogh, III | 62/150 |
| 2001/0025349 | A1 | 9/2001 | Sharood et al. | |
| 2003/0013459 | A1 * | 1/2003 | Rankin et al. | 455/456 |
| 2004/0050072 | A1 | 3/2004 | Palfy et al. | |
| 2004/0159113 | A1 * | 8/2004 | Singh et al. | 62/129 |
| 2005/0011205 | A1 * | 1/2005 | Holmes et al. | 62/156 |
| 2006/0196206 | A1 | 9/2006 | Murray et al. | |
| 2012/0067072 | A1 * | 3/2012 | Malwitz et al. | 62/152 |

FOREIGN PATENT DOCUMENTS

GB 2455513 A * 6/2009

* cited by examiner

*Primary Examiner* — Chen Wen Jiang
(74) *Attorney, Agent, or Firm* — Etherton Law Group, LLC; Sandra L. Etherton

(57) ABSTRACT

An improved refrigerator energy management system removes condensation from glass refrigerator doors in an energy efficient manner by operating refrigerator frame heaters independently of refrigerator door heaters. Sensors for detecting humidity or condensation transmit data to a control unit that controls electrical current supplied to separate door and frame heater wires. Additional sensors for controlling the refrigerator lighting and monitoring the power consumption of refrigerator fans may transmit data to the control unit. A command unit may receive data from multiple control units, compile the data, and make it available over the internet to a shopkeeper monitoring the system from a remote location. The sensors, control unit, and command unit all communicate on a wireless peer-to-peer network using the ZigBee protocol.

18 Claims, 8 Drawing Sheets

SYSTEM FOR PREVENTING CONDENSATION ON REFRIGERATOR DOORS AND FRAMES

CROSS-REFERENCE TO RELATED APPLICATIONS

This application claims the benefit of and is a continuation-in-part of co-pending application Ser. No. 11/228,602, filed Sep. 16, 2005, which is a continuation-in-part of application Ser. No. 10/778,289, filed Feb. 11, 2004, now U.S. Pat. No. 7,240,501, both of which are incorporated herein by reference.

FIELD OF INVENTION

This invention relates generally to refrigeration devices. This invention relates particularly to a device for managing energy consumption by a refrigerator while maintaining protection against condensation.

BACKGROUND

Shopkeepers display refrigerated or frozen products in temperature-controlled display cases, such as refrigerators with glass display doors or open-air, "coffin," coolers. The refrigerators and freezers are referred to herein as "refrigerators." Changes in temperature and humidity in the surrounding area cause condensation and frost to build up on the refrigerators. Condensation on doors obstructs visibility of the products, while condensation that builds on the outer surface of the refrigerator frame causes unsafe conditions when it falls and pools on the floor. It is therefore desirable to prevent the build-up of condensation and frost on refrigerators.

To combat condensation and frost, heaters are installed in refrigerator doors and frames, which raise the temperature of the door or frame sufficiently to eliminate condensation. Typically these heaters run constantly, but devices that control whether the heaters are on or off are known in the art. They are referred to generally as anti-sweat controllers. Anti-sweat controllers may use one or more condensation sensors attached to one or more doors or the frame, turning on the heaters when condensation is sensed. Traditionally, a single control box is used to control all the sensors of a given refrigerator. These devices fail, however, to prevent condensation because the heater is not activated until after condensation is sensed. It is known in the art to instead use a humidistat to sense humidity in the aisle and, when the humidity goes above a given level, the heater is turned on, often regardless of whether condensation is actually present. This increases energy consumption because the humidity in the aisle is not always indicative of the conditions on the door surface, so condensation may not be imminent. In this approach, the heaters are either constantly on or turned on unnecessarily. It would be desirable to prevent condensation with the minimum amount of heat, and consequent energy expenditure, necessary.

Anti-sweat controllers activate and deactivate door and frame heaters by supplying or denying an electrical current over a heater wire. In a refrigerator having a door heater and a frame heater, known anti-sweat controllers activate both heaters even if one heater is unneeded at that time. This design causes expenditure of up to twice as much energy as necessary, the most wasteful case being when the door and frame heaters are never needed simultaneously. It is desirable to better manage the power usage of the heaters to increase energy efficiency.

Refrigerators have fans to help regulate the interior temperature. Typically, a refrigerator has the same number of fans as it has doors, with fan motors connected to a common power supply. The fans are normally turned on at all times. Eventually, fan motors fail. The power usage of a failing fan motor may fluctuate for a period before its failure, and the power usage of all fan motors may spike after the failure. This may cause unnecessary temperature fluctuations that can lead to condensation, and also affects the refrigerator's energy efficiency. Additionally, fans are typically installed near the bottom of the refrigerator, where they are susceptible to water damage if the refrigerator floods during cleaning or a problem. It is desirable for an anti-sweat controller to monitor the fans and protect them from failure and overload.

Lighting a refrigerator also contributes heavily to the refrigerator's energy usage. In a commercial setting, periods may pass wherein no customers walk by the refrigerator, so illuminating the interior of the refrigerator is not needed. Known energy management techniques include placing a motion detector on the refrigerator or in the aisle and turning on the lights when motion is sensed. While this approach conserves some energy, it also shortens the life of refrigerator lights. It would be advantageous to control the lights in a way that does not shorten the life of the lamps, and further would be advantageous for the anti-sweat controller to control the lights in order to reduce the amount of required hardware for refrigerator energy management.

The anti-sweat controller may control a number of factors that must be set correctly to reduce energy consumption and eliminate condensation, including sensitivity of the sensors and duration of an "on" or "off" signal on a power circuit. To date, these factors have been measured and controlled by manually adjusting various currents and voltages on each control box with a multimeter. For a store with multiple refrigerators and multiple anti-sweat controllers, the multimeter must be plugged into each separate controller in order to adjust the entire system. Detecting the specific location of an electrical failure is frustrating and time consuming due to the need to test each separate device. Balancing the system becomes tedious. As a result, it is desirable to reprogram, monitor, and control an anti-sweat controller system without having to plug into each control box on each refrigerator and without having to make on-site visits to each store. Specifically, it would be desirable to provide a control box that could be programmed from a remote location using the Internet.

Known anti-sweat controllers connect the control box to the sensors with wires that transmit and receive data between the sensors and control box. Hardwiring the various sensors to the control box is problematic as it increases the time needed to install anti-sweat controllers. Additionally, the wires can be accidentally cut which results in a non-functioning anti-sweat controller which may require a qualified repairman to fix. It would be desirable to provide an anti-sweat controller that utilized wireless sensors to communicate with the control box to eliminate these communication wires.

Additionally, anti-sweat controllers are hardwired into the local power source, which results in difficult access for repair and replacement because the anti-sweat controllers must be unwired each time they are removed and rewired each time they are reinstalled. If the anti-sweat controller breaks, the fact that the system is integral with the local power source may cause the shopkeeper to be unable to set the system to keep the heaters on until a qualified repairman fixes the problem. Further, the dismantling and reconstruction cause safety issues while obstructing customer access to the refrigerators. It would be desirable to provide an anti-sweat controller that is connected to the power source with a quick-disconnect plug enabling it to be easier to install, repair and replace and that provides a means for the shopkeeper to mitigate problems if a controller fails.

Therefore, it is an object of this invention to provide an anti-sweat controller that operates a heater where condensation has not yet been detected but is anticipated. It is another object to increase energy efficiency by designing the anti-sweat controller to activate only the heaters that are needed at any time, and to manage the amperage of the heaters more efficiently. Another object is to monitor the power usage of refrigerator fans and generate an alert if fan power becomes erratic. A further object is to monitor the water level in the refrigerator to protect fans. It is another object to control the power usage of refrigerator lighting. It is another object of this invention to provide ease of programming, repair, and reinstallation by providing an anti-sweat controller with sensors and control boxes that communicate wirelessly. It is an additional object of the invention to provide remote monitoring and control of an anti-sweat controller over the internet.

SUMMARY OF THE INVENTION

The present invention is a device for managing energy consumption of refrigerator components. A control unit connects to one or more door heaters via a door heater wire, and to one or more frame heaters via a frame heater wire, and is configured to operate the frame heaters independently of the door heaters. The control unit communicates with one or more condensation sensors to determine when to supply power to the heaters. The control unit also communicates with one or more fan sensors to monitor power consumption by fans in the refrigerator. The control unit also controls power supplied to lights in the refrigerator. The control unit may communicate with other sensors that report conditions in the refrigerator, including humidity, temperature, light, motion, and water level sensors. The control unit and sensors are capable of transmitting and receiving data wirelessly. A command unit is used to enable remote monitoring and control of one or more control units. The command unit may communicate wirelessly with the control units. The command unit may be connected to the Internet to enable a user to monitor and control the control units from a remote location.

DETAILED DESCRIPTION OF THE INVENTION

Figure 1:
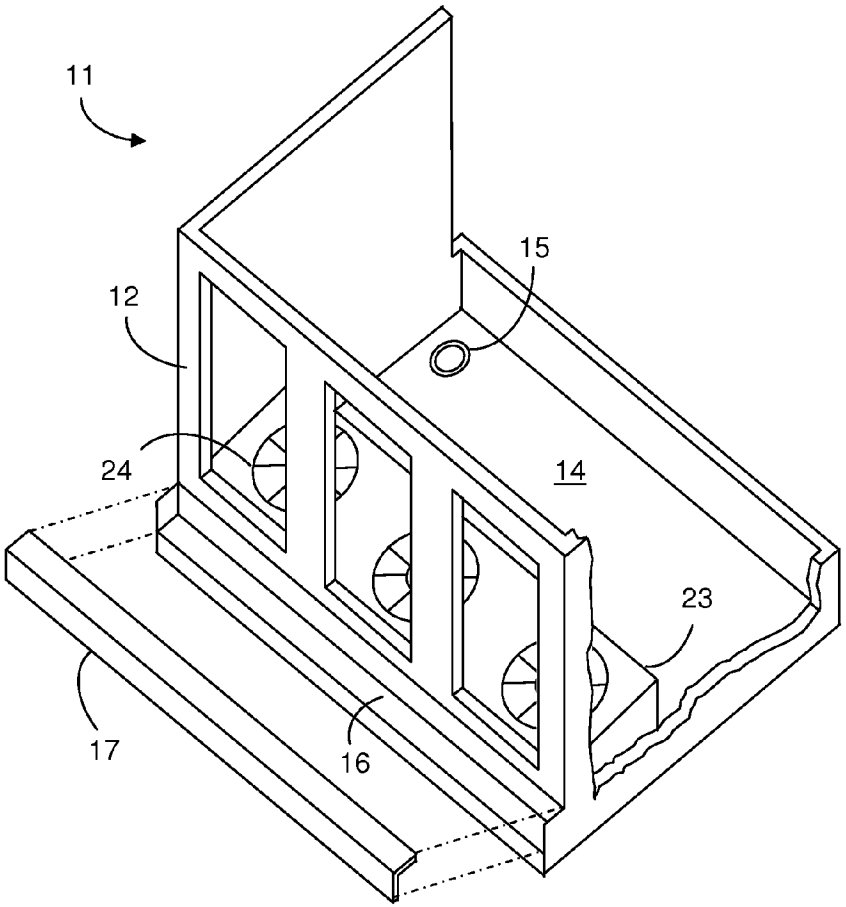
FIG. 1 is a top-front isometric view of a refrigerator.
Figure 2:
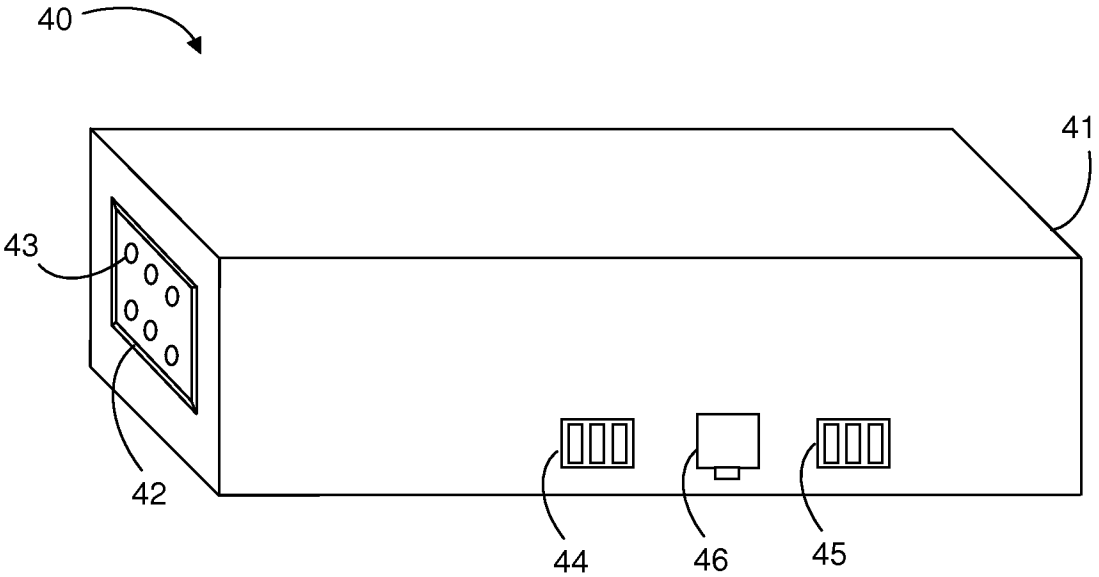
FIG. 2 is a left-side perspective view of a control unit.
Figure 3:
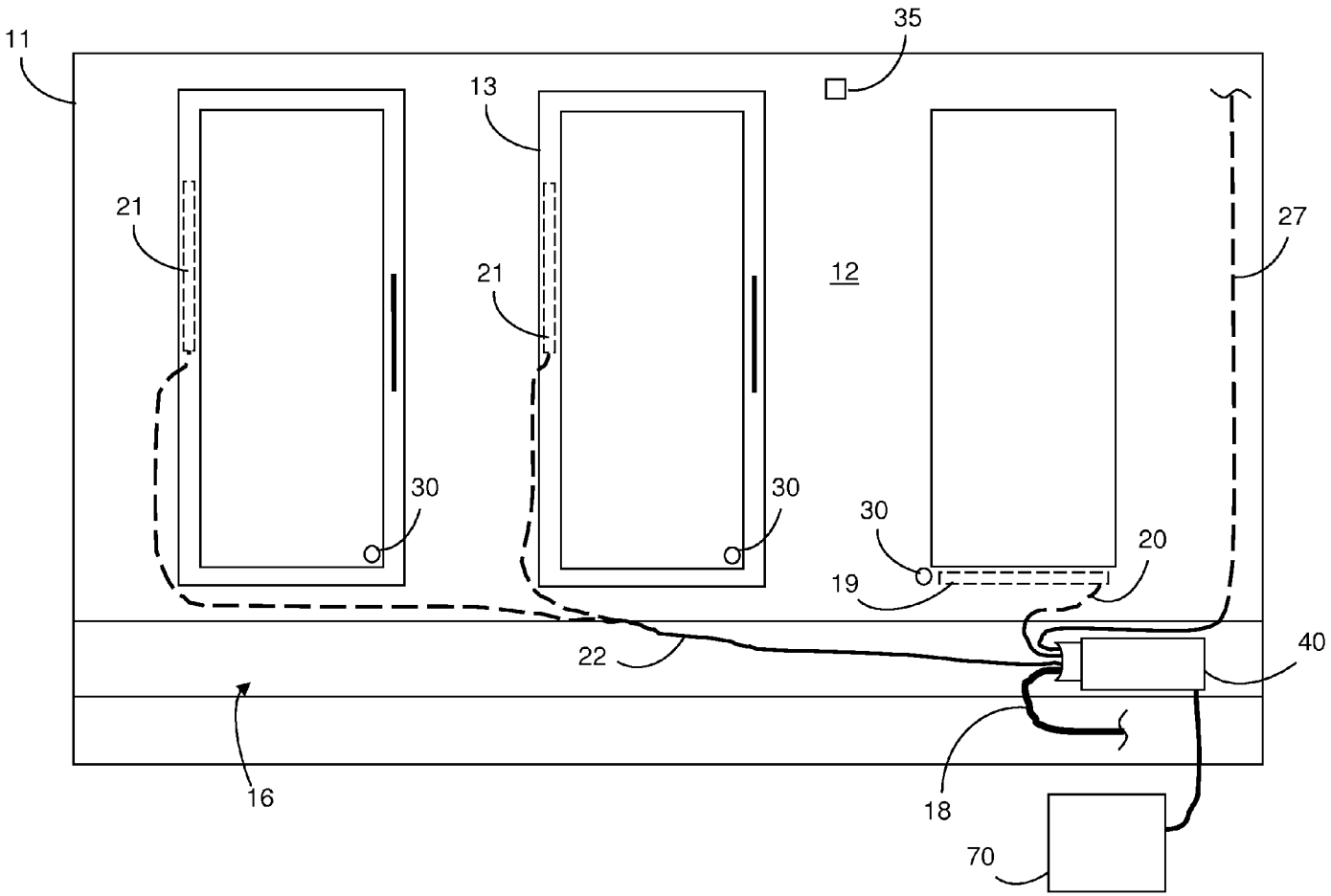
FIG. 3 is a front view of the control unit of FIG. 2 installed on the refrigerator of FIG. 1.

Referring to FIGS. 1-4, a refrigerator control and monitoring system is used to manage energy consumption and prevent condensation on the doors 13 and frame 12 of a refrigerator 11. The system comprises a control unit 40 that receives input from one or more sensors and uses the input to manage the refrigerator 11. The control unit 40 controls the operation of the refrigerator's 11 frame heaters 19, which contact the frame 12, and door heaters 21, which contact the door's 13 frame or glass, by supplying or denying power to the heaters 19, 21. The control unit 40 may further control the operation of refrigerator 11 fans 24 and lights (not pictured). The control unit 40 may transmit collected sensor data to a central monitoring station, such as a computer 70 or a separate command unit 71 as described below. In the preferred embodiment, the system includes one control unit 40 for each refrigerator 11 in a store or other location. Each control unit 40 is located apart from the heaters 19, 21 and may operate one or more of each heater 19, 21.

The control unit 40 has a housing 41 containing the control unit's 40 electrical components. The housing 41 is designed to shield the components from electrical interference and may be insulated. Preferably, the housing 41 fits into the wiring gutter 16 that runs along the front or back of the refrigerator 11, so it may be hidden from sight by the cover 17. A coupling 42 is mounted at one end of the housing 41. The coupling 42 may be a quick-disconnect 5-, or 6-wire mate-and-lock connector having connectors 43 for connecting the desired voltage-supplying wires to the control unit 40. Other quick-disconnect plugs that provide simple, rapid separation of the spliced wires without the use of tools may be used. The coupling 42 enables a shopkeeper to disconnect the control unit 40 from the voltage-supplying wires without unwiring the system, allowing the heaters 19, 21 to revert to their always-on state and prevent condensation until a qualified repairman can fix the system. Alternatively, the heaters can be turned completely off. The coupling 42 also provides for a control unit 40 to be removed and installed much more safely and quickly than prior art devices. At the coupling 42, the control unit 40 is connected to hot, neutral, and ground wires collectively referred to as the main power wire 18. The main power wire 18 in turn connects to a power source, preferably an AC power supply such as mains power. The coupling 42 also connects the control unit 40 to at least a frame heater power wire 20 and a door heater power wire 22. The frame heater power wire 20 connects to one or more frame heaters 19 and the door heater power wire 22 connects to one or more door heaters 21. A lighting control wire 27 may also be connected at the coupling 42. The lighting control wire 27 transmits power to the refrigerator 11 lights.

A dry contact port 44 is mounted in the side of the housing 41. The dry contact port 44 is preferably a 3-position terminal block header that implements Form C dry contacts. The dry contact port 44 allows another in-store device to attach to the control unit 40 and receive data for monitoring of three different circuits that are managed by the control unit 40. In the preferred embodiment, a circuit for the heaters 19, 21, a circuit for the fans 24, and a circuit for the lights are connected to the dry contact port 44. A data transfer port 45 is mounted in the side of the housing 41. The data transfer port 45 is used to connect the control unit 40 to one or both of a computer 70 or a command unit 71 as described below. The data transfer port 45 is preferably the same type of terminal block header as the dry contact port 44, and preferably adheres to the EIA-485 electrical standard, although other electrical standards may be used. The system may include an EIA-485-to-USB adapter that allows direct connection between the data transfer port 45 and a USB port on the computer 70. In embodiments where the control units 40 in the system communicate using the EIA-485 electrical standard, it is preferred that the control units 40 are connected at each control unit's data transfer port 45 in a daisy-chain arrangement in order to prevent signal reflections. Other wired embodiments may provide for parallel, star-topology, or other connection arrangements.

The control unit 40 may include one or more communication ports 46 to which wired sensors may be attached. These communication ports 46 are not necessary if the control unit 40 is configured to communicate with wireless sensors in the system. A communication port 46 may accept any typical wired sensor connector, including four-position-four-contact ("4P4C") and Registered Jack ("RJ") connectors.

Figure 5:
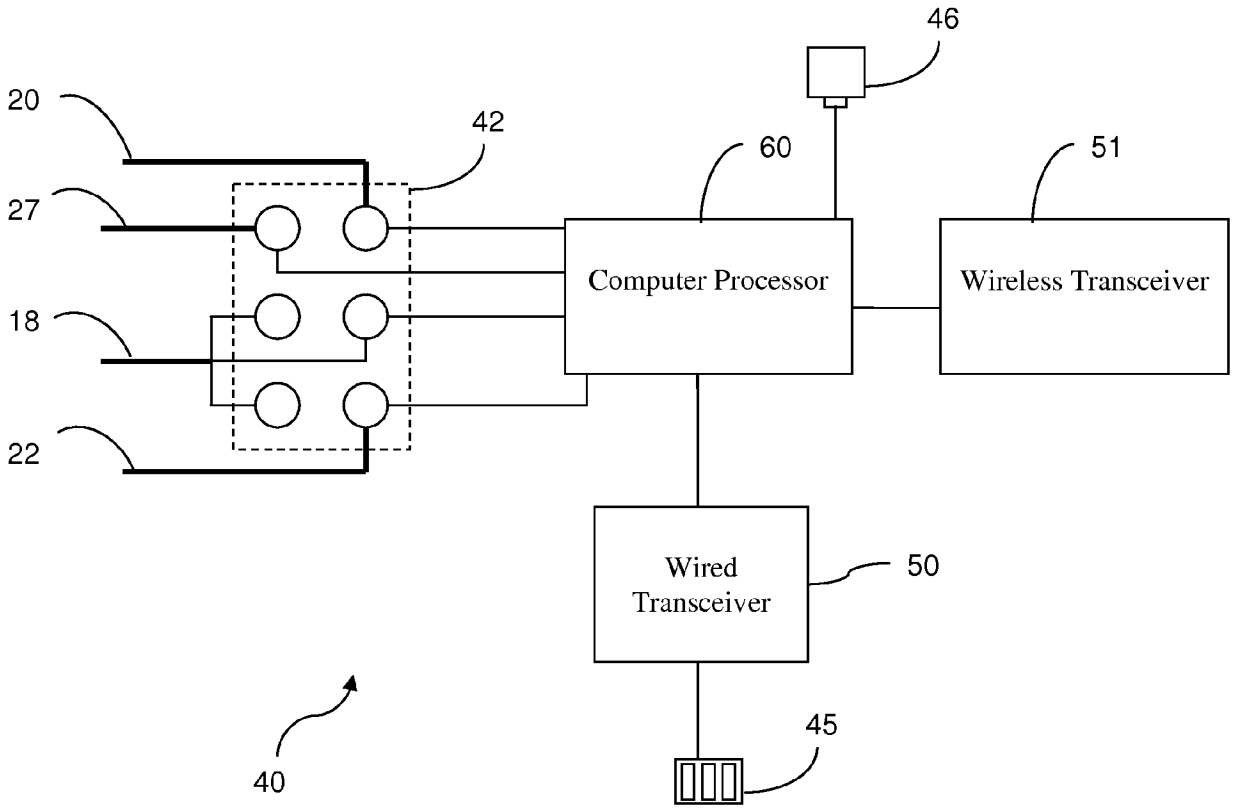
FIG. 5 is a logic diagram of the electrical components of a control unit.
Figure 6:
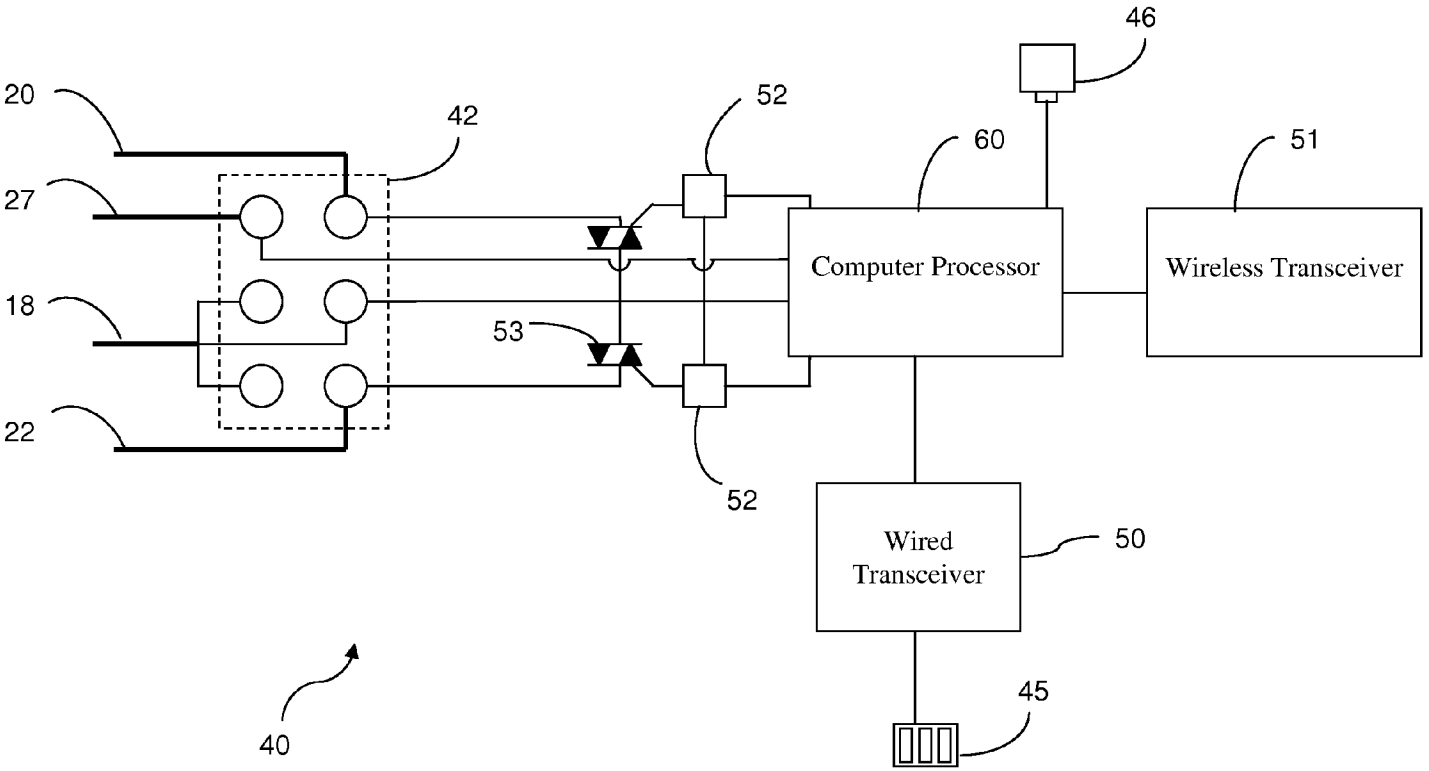
FIG. 6 is a logic diagram of the electrical components of an alternative embodiment of a control unit.

Referring to FIGS. 5 and 6, the electrical components in the control unit 40 are connected to, and preferably surface-mounted to, at least one printed circuit board ("PCB"). Conductive paths are etched into or overlayed onto the printed circuit board to provide electrical connections between components. In contrast to prior art anti-sweat controllers which relied on discrete and analog components, the present invention utilizes integrated circuits and digital transmissions for increased sensitivity, control, and reliability. A computer processor 60 is mounted on the PCB and controls the operation of the control unit 40 based on parameters programmed into the computer processor 60. The computer processor 60 is preferably a custom-programmed microcontroller that includes a timer, memory and an analog-to-digital converter. Alternatively, the timer and one or more analog-to-digital converters may be separate integrated circuits mounted on the PCB. The computer processor 60 is in electrical communication with any communication ports 46 in order to receive data from wired sensors and to transmit data between other control units that are connected to the control unit 40.

At least one transceiver is mounted to the PCB and in electrical communication with the computer processor 60. A wired transceiver 50 connects to the data transfer port 45 to transmit data between the computer processor 60 and the computer 70 or command unit 71. The preferred wired transceiver 50 is a 5-volt transceiver for the EIA-485 standard, made by ST Electronics. A wireless transceiver 51 may perform the same data transmission tasks, and also communicate with wireless sensors and transceivers from other control units 40, once the wireless transceiver 51 is configured to communicate on the physical network as described below. One or both of the transceivers 50, 51 may be used, depending on the implementation of the system. In the preferred embodiment, both transceivers 50, 51 are present in the control unit 40. Alternatively, a single transceiver that performs the functions of both the wired transceiver 50 and the wireless transceiver 51 may be used.

Additional control circuitry in the form of integrated circuits and other electrical components may be used to process signals and manage electrical current exchange between low-voltage components, such as the computer processor 60, and high-voltage input from the power source. These components are described by way of example in the embodiments discussed below.

The preferred embodiment of the system operates on a wireless peer-to-peer network or a star topology physical network using the Zigbee protocol or a similar protocol. While any wireless communication standard can be used and fall within the scope of the present invention, the IEEE 802.15.4 Zigbee standard is preferred because it allows the network to automatically change to a different communication frequency if the signal is experiencing interference. In this regard, data is sent in packets between the wireless transceiver 51 and the sensors, computer 70, command unit 71, and other control units that may be present on the network. The IEEE 802.15.14 standard for Wireless Medium Access Control (MAC) and Physical Layer Specifications for Low-Rate Wireless Personal Area Networks (LR-WPANs) is available from the Institute of Electrical and Electronics Engineers, Inc. of New York, N.Y., and is herein incorporated by reference. Other short-range, wireless networks could be used and fall within the scope of the present invention including a Bluetooth wireless network. A control unit 40 is added to the network by first connecting it to the computer 70 at the data transfer port 45. An address on the network may be assigned to the control unit 40. Once the wireless transceiver 51 can communicate over the network, the control unit 40 may be programmed by input devices on the network, including the computer 70, command unit 71, or other devices such as the shopkeeper's personal digital assistant ("PDA") or smart phone, or the control unit 40 may be programmed by the computer 70 using the wired connection at the data transfer port 45.

The computer processor 60 is programmed to perform certain tasks based on input conditions from sensors and, preferably, an internal or external clock. The input condition on which action is taken will depend on the type of information being sensed. As described below, some sensors will report data continuously or at predetermined intervals, and the computer processor 60 performs a task if the reported data reaches a programmed threshold value. Other sensors send an input signal only when a sensor-based condition is reached, such as a capacitive humidity sensor signaling that condensation is present on the sensor, and the computer processor 60 performs a task when the input signal is received.

The control unit 40 operates the frame heaters 19 and door heaters 21 based on sensor data, time of day, or both. The control unit 40 may activate and deactivate the frame heaters 19 synchronously or asynchronously with the door heaters 21; that is, the frame heaters 19 and door heaters 21 may be operated independently of each other, based on time, humidity or temperature conditions, other factors, or a combination of these. The computer processor 60 is configured to output two control signals. One control signal instructs the control circuitry to supply amperage from the main power wire 18 to the frame heater power wire 20. The other control signal instructs the control circuitry to supply amperage from the main power wire 18 to the door heater power wire 22. The separate control signals allow the control unit 40 to supply different amperages to the heater power wires 20, 22, which provides an energy usage advantage over existing units that supply a single amperage to all heaters. In one embodiment, shown in FIG. 6, a control signal causes current to flow through an optoisolator 52, subsequently opening a TRIAC switch 53 that allows current to flow to the heater power wire that is connected to the corresponding port in the coupling 42. In another embodiment, the computer processor 60 supplies the control signal directly to a digital gate that opens to allow current to pass to the corresponding heater power wire.

The control unit 40 may also be configured to operate the refrigerator 11 lights based on sensor data, time of day, or both. The computer processor 60 manages voltage supplied to the lighting control wire 27 similarly to its management of the frame heater power wire 20 and door heater power wire 22, resulting in on or off states for the lights. Additionally, the computer processor 60 may be programmed to dim the lights by pulsing a current of at most about 5 amps to the lighting control wire 27. The dimming allows the refrigerator 11 lights to remain excited, limiting the number of start cycles for the lights.

The control unit 40 may also monitor operation of the fans 24 using sensor data. The computer processor 60 is programmed to send an alert signal to the computer 70 or command unit 71 based on failure or threshold conditions described below. The alert signal may be further processed by the computer 70 so it is readable by the shopkeeper or a repair technician.

Referring back to FIGS. 3 and 4, the system may include one or more sets of anti-sweat sensors, fan sensors, and lighting control sensors. Anti-sweat sensors 30 are attached to the refrigerator 11, positioned uniquely for each refrigerator 11 where condensation forms the soonest, preferably on the doors 13 and the headers or mullions of the frame 12. In the preferred embodiment, anti-sweat sensors 30 are located on the frame 12 by each door 13 and on the glass of the doors 13 themselves. The anti-sweat sensors 30 are preferably capacitive sensors capable of detecting both relative humidity levels and temperature. Each anti-sweat sensor 30 may be equipped to communicate wirelessly on the wireless network, preferably using a ZigBee protocol network. Specifically, anti-sweat sensors 30 are programmed wirelessly by inputting parameters into the computer 70 or control unit 40, which in turn adjusts the anti-sweat sensors 30. Alternatively, the anti-sweat sensors 30 may be wired sensors that plug into one or more of the communication ports 46. A wired or wireless temperature sensor 32 may be placed inside the refrigerator 11 and transmit temperature data to the control unit 40 as the anti-sweat sensors 30 do.

Adjustments that may be made to the sensors 30, 32 include lowering the set point of the sensors 30, 32 and thereby decreasing sensitivity. For example, if the set point of a particular anti-sweat sensor 30 is set high, such that a frame heater 19 is instructed to turn on when very little humidity is present, the frame heater 19 will turn on as the lightest condensation occurs. However, if the sensitivity is set lower, such that the frame heater 19 turns on only when significantly more humidity is measured, the frame heater 19 will turn on when more condensation is present. Ideally the sensitivity is adjusted to maintain an optimum balance between condensation and the amount of time the heaters are on. Of course, the less the heaters are on, the less energy is consumed by the system and the lower the energy costs.

In operation, the control unit 40 receives from the anti-sweat sensors 30 and temperature sensor 32 data regarding the temperature or humidity at that sensor's location. Where the data is reported continuously or at predetermined intervals, the computer processor 60 compares the received data to programmed thresholds. If a certain threshold has been reached at a door 13, the computer processor 60 will activate the door heaters 21 until the anti-sweat sensor 30 that exceeded the threshold returns to acceptable levels. The computer processor 60 activates the frame heaters 19 if the threshold condition on the frame 12 is similarly exceeded. Alternatively, where the anti-sweat sensors 30 only signal the computer processor 60 when a certain humidity is reached, the computer processor 60 will activate the corresponding heaters in response to such a signal, and will deactivate the heaters when the signal stops.

To anticipate condensation, the control unit 40 signals when the heaters should be on prior to the formation of condensation, for example, at preset start and stop times consistent with when condensation is anticipated. For example, in the context of supermarket refrigerator doors 13, the door heaters 21 could be set to run once every hour, on the hour, between 6 a.m. and 9 a.m., 12 p.m. and 1 p.m., and 5 p.m. and 9 p.m. (times corresponding to when the supermarket is very busy, refrigerator doors are repeatedly opened, and condensation is anticipated). Frame heaters 19 typically operate for about 7 hours per day due to the temperature difference between the interior and exterior of the refrigerator 11, particularly on surfaces with little or no insulation such as on the mullion. Door heaters 21 are needed significantly less often, the preset operating times may be set to provide for different duty cycles for the frame heaters 19 and door heaters 21, so that the duration of operation of the door heaters 21 is shorter than the duration of operation of the frame heaters 19. These preset times work in cooperation with the sensors, which may override the preset times. For example, in the event the pre-set cycle time is insufficient to prevent condensation, anti-sweat sensor 30 or temperature sensor 32 data can override the pre-set "off" time and cause the heater to run until no more condensation is detected. The preset operating times are programmed into the computer processor 60, which synchronizes its instructions with an internal or external clock.

Fan sensors may include one or more fan power sensors 33 and a water level sensor 34. The fan power sensors 33 are multimeters or other current-measurement devices that detect the amperage flowing to one or more fan 24 motors. In one embodiment, illustrated in FIG. 4, the system uses a single fan power sensor 33, disposed around all of the fan power wires 26, that reports the real-time amperage of all of the fans 24 in a refrigerator 11. The computer processor 60 compares this value to a stored threshold amperage value to determine if all of the fan motors are operating efficiently. If the reported amperage is considerably lower than expected or is varying erratically, it may be a sign that one or more fan motors is failing or has failed. In this case, the computer processor 60 sends an alert signal to the computer 70 or command unit 71, notifying the shopkeeper or a repair technician of the potential problem. In another embodiment, the system uses a fan power sensor 33 for each fan motor in the refrigerator 11, so that the computer processor 60 can identify which fan motor is malfunctioning when it sends the alert signal.

Figure 4:
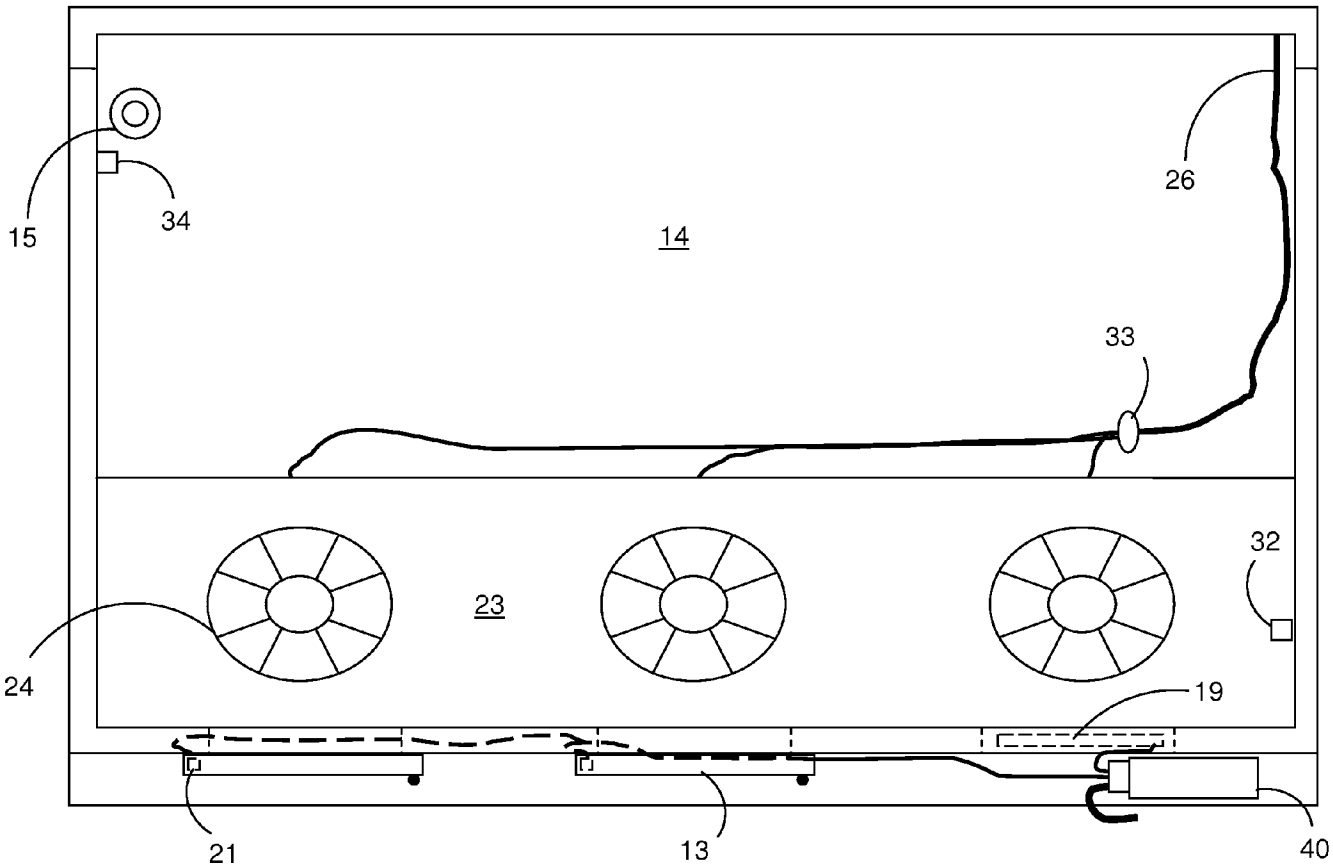
FIG. 4 is a top view of the control unit and the interior of the refrigerator of FIG. 3.

The water level sensor 34 may be positioned near a drain 15 in the floor 14 of the refrigerator 11, as shown in FIG. 4. The water level sensor 34 sends a signal to the computer processor 60 if the drain 15 becomes clogged and water begins to flood the refrigerator 11, submerging the water level sensor 34. The water level sensor 34 is placed lower than the fans 24, and preferably lower than the fan mount 23, so the alert is sounded before the water level begins to submerge the fans 24. If fan power sensors 33 are used, the water level sensor 34 should also be lower than the fan power sensors 33 to prevent the fan power sensors 33 from being submerged.

A suitable lighting control sensor is typically a motion sensor 35 positioned in the store aisle or on the front of the refrigerator 11. The motion sensor detects the presence of customers or staff and signals the computer processor 60, which cycles the lights from an "off" or "dim" state to an "on" state by supplying a constant current to the lighting control wire 27. The motion sensor 35 may operate in conjunction with the store's open and closed times that are programmed into the computer processor 60, so that the lighting circuit only responds to motion at certain times of the day. Additional preset times may be programmed that instruct the computer processor 60 to cycle the lights from their "on" state to either their "off" state or their "dim" state, depending on the time of day.

Figure 7:
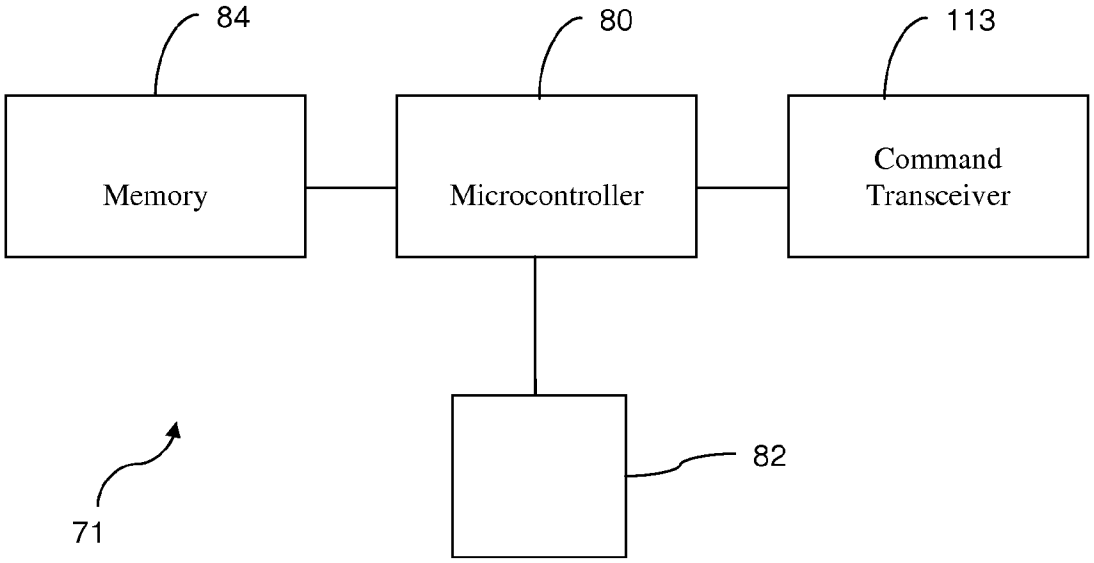
FIG. 7 is a logic diagram of the electrical components of a command unit.
Figure 8:
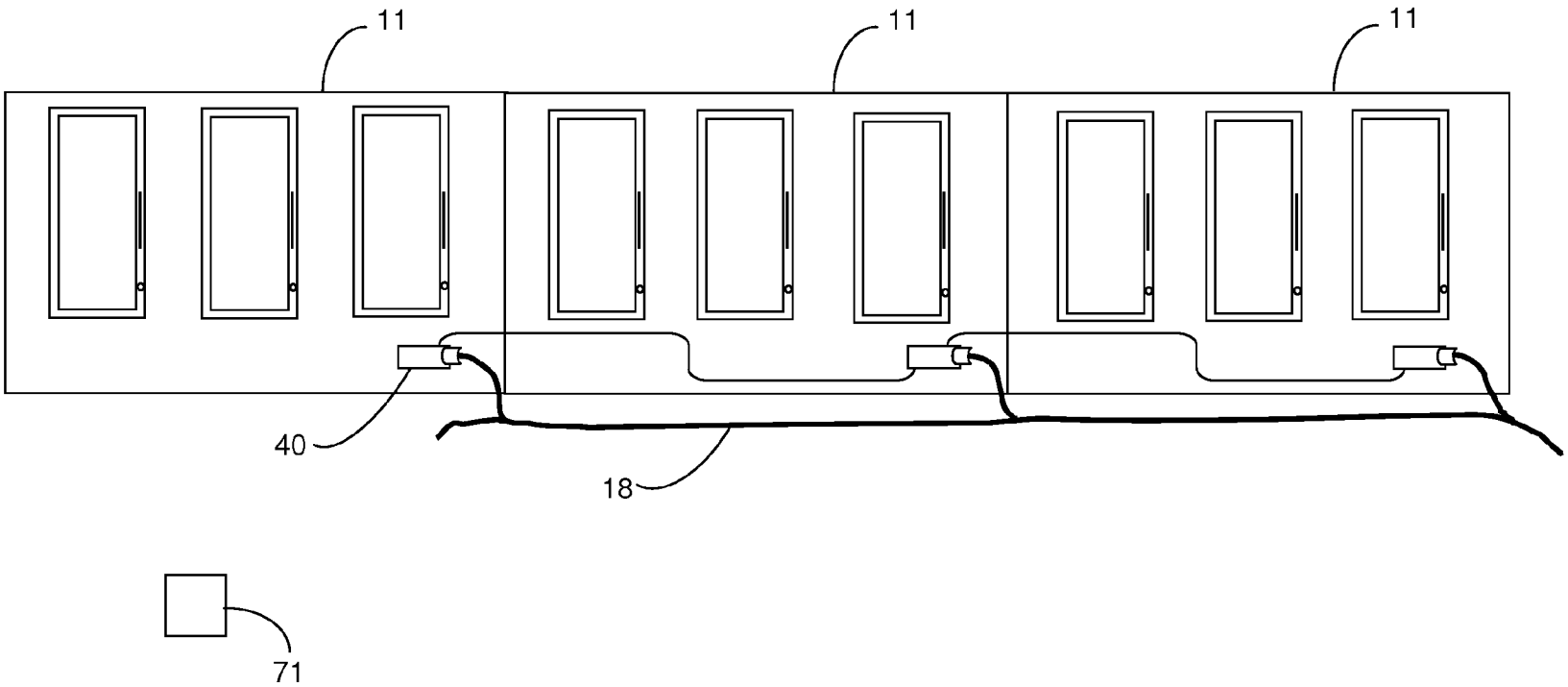
FIG. 8 is a front view of control units installed on three refrigerators and communicating wirelessly with a command unit.

Referring to FIGS. 7 and 8, the command unit 71, while not necessary to the operation of the system, is preferably used to coordinate and program the control units 40 on the network. In the preferred embodiment, the command unit 71 functions essentially like a server, being capable of transmitting data gathered from the control units 40 over the Internet to the shopkeeper, who can then monitor and adjust the control units 40 and the sensors through the command unit 71 from a remote location. The command unit 71 is generally located apart from the refrigerators 11 and is preferably equipped with an Ethernet connection. The command unit 71 comprises a microcontroller 80, command unit power source 82, command transceiver 113, and memory 84. The microcontroller 80 preferably includes an integrated Ethernet Media Access Controller and 10/100 Ethernet Physical Layer and on-chip flash memory. In the preferred embodiment, the microcontroller 80 is custom programmed for this specific application as known in the art. An acceptable microcontroller 80 is available from Freescale Semiconductor, Inc. and sold as part number MC9S12NE64. To protect the various components from damage, the command unit 71 can include a housing. An acceptable housing is available from Hammond Manufacturing of Cheektowaga, N.Y. and sold as part number 1593X. Additionally, the command unit power source 82 can either be batteries or alternating current that has been adjusted by a transformer such as an AC adapter.

The command unit 71 receives data from the control units 40 and stores the data in a database. The database can be accessed over the internet by any other computer that is connected to the internet. In the preferred embodiment, a shopkeeper would be able to review the data in the database on the internet. The shopkeeper could view data collected in the database relating to the various times that the heaters turned on and off to reduce humidity and condensation within the refrigerator and make adjustments if necessary. The database may also contain the raw data reported by the sensors and transmitted to the command unit 71 by the control units 40 or directly from the sensors themselves. The ability to adjust the system components and review the data collected in the database is greatly simplified since the control units 40, sensors, and command unit 71 communicate on a wireless network.

The advantages of the present inventive system can be illustrated by the following example. In a store with ten refrigerators 11, the ten corresponding control units 40 may be set to turn their corresponding heaters on at peak times and cycle the heaters for a predetermined interval: the frame heaters 19 are activated at 7:30 a.m. and 5:00 p.m. and run for 15 minutes, and the door heaters 21 are activated at 7:35 a.m. and 5:05 p.m. and run for five minutes. When the humidity or temperature reach the programmed thresholds, the control units 40 activate the corresponding heaters and transmit wireless data related to the time that the heaters turned on and the duration that they were on to the command unit 71, which transfers this data into the database.

The command unit 71 has a connection to the internet, such as through local area network, and makes this data available to the shopkeeper, who can log onto the database via the internet and view that data which shows that the heaters are being activated. Upon reviewing this data, the shopkeeper decides to modify the settings for the heaters in some of the refrigerators so that they are activated at 2:50 p.m. in an effort to prevent condensation before it is likely to form. The shopkeeper simply makes the adjustment on a computer which is sent over the internet to the command unit 71. The command unit 71 wirelessly transmits this adjustment data to the control units 40 for the relevant refrigerators 11 which are programmed to turn on both sets of heaters 19, 21 at 2:50 p.m., running the frame heaters 19 for another 15 minutes and the door heaters 21 for another five minutes, in addition to the normal operating times.

Therefore, the shopkeeper can monitor and control the anti-sweat controllers for a given store in any location where Internet access is available. Moreover, the number of anti-sweat controllers that can be monitored in this fashion is unlimited. Therefore, a shopkeeper can monitor the heaters 19, 21 in a single store or dozens of stores in different locations if he so desires. Additionally, because the anti-sweat controller's operation can be monitored via the Internet, it is easier to diagnose if a problem exists. For example, if a heater fails, a shopkeeper can view the data about the operation of the anti-sweat controller and easily determine which heater is malfunctioning.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

What is claimed is:

1. A system for controlling energy usage in a refrigerator having:

a) a frame;

b) a frame heater attached to the frame;

c) a door attached to the frame; and d) a door heater attached to the door;

the system comprising a control unit connected to the frame heater and the door heater and configured to activate and deactivate the frame heater independently of activating and deactivating the door heater, wherein the control unit is configured to activate and deactivate the frame heater asynchronously from activating and deactivating the door heater.

2. The system of claim 1 wherein the control unit comprises:

a) a housing;

b) a coupling mounted on the housing, the coupling electrically connecting the control unit to a power source by a main power wire, to the frame heater by a frame heater wire, and to the door heater by a door heater wire;

c) a computer processor in electrical communication with the coupling; and d) at least one transceiver in electrical communication with the computer processor.

3. The system of claim 2 further comprising a first anti-sweat sensor attached to the door and configured to send data regarding humidity near the door to the computer processor via the transceiver.

4. The system of claim 3 wherein the data regarding humidity comprises the humidity level, and wherein the computer processor is programmed to activate the door heater if the humidity level exceeds a predetermined threshold.

5. The system of claim 3 wherein the data regarding humidity comprises an input signal that is generated when the first anti-sweat sensor detects humidity that exceeds a predetermined threshold, and wherein the computer processor is programmed to activate the door heater if the input signal is received.

6. The system of claim 3 further comprising a second anti-sweat sensor attached to the frame and configured to send data regarding humidity near the frame to the control unit.

7. The system of claim 2 wherein the refrigerator further comprises at least one fan having a fan motor, the system further comprising a fan power sensor configured to detect the amperage of the fan motor and transmit data comprising the amperage to the computer processor.

8. The system of claim 7 wherein the computer processor is programmed to:

a) compare the amperage to a predetermined threshold to determine if the fan motor is working properly; and b) send an alert signal to a computer in communication with the transceiver if the comparison indicates that there is a problem with the fan motor.

9. The system of claim 7 wherein the refrigerator comprises a floor with a drain therein, the system further comprising a water level sensor positioned near the drain and configured to alert the computer processor if the water level sensor becomes submerged in water.

10. The system of claim 2 wherein the coupling electrically connects the control unit to one or more lights by a lighting control wire, and wherein the computer processor is configured to control the lights.

11. The system of claim 10 further comprising a motion sensor positioned outside the refrigerator and configured to notify the computer processor when motion is detected, wherein controlling the lights comprises supplying or denying an electrical current to the lighting control wire based on the time of day and whether motion is detected.

12. The system of claim 11 wherein placing the lights in a "dim" state comprises pulsing a current supplied to the lighting control wire.

13. The system of claim 2 further comprising a command unit in communication with the control unit, the command unit comprising:

a) a microprocessor;

b) an access controller that is connected to the internet; and c) a command transceiver that sends and receives data between one or more of the transceivers in the control unit.

14. The system of claim 13 wherein the computer processor may be programmed by inputting parameters over the internet, the parameters being transmitted to the command unit and subsequently to the computer processor.

15. The system of claim 13 wherein the command transceiver and the transceiver in the control unit with which the command transceiver communicates are wireless transceivers.

16. The system of claim 15 wherein the command unit and control unit communicate on a wireless network compliant to the IEEE 802.15.4 standard.

17. The system of claim 1 wherein the computer processor is programmed to:

a) activate the door heater at a first predetermined time for a first predetermined duration; and b) activate the frame heater at a second predetermined time for a second predetermined duration.

18. The system of claim 17 wherein the computer processor is programmed to:

a) receive input from one or more anti-sweat sensors; and b) override activation of the door heater at the first predetermined time based on the input.

* * * * *